US008665106B2

(12) United States Patent
Heidvall et al.

(10) Patent No.: US 8,665,106 B2
(45) Date of Patent: Mar. 4, 2014

(54) PERSONAL AUDIO CABLE ALARM DEVICE

(76) Inventors: Lina Heidvall, Stockholm (SE); Johan Enander, Stockholm (SE)

( * ) Notice: Subject to any disclaimer, the term of this patent is extended or adjusted under 35 U.S.C. 154(b) by 163 days.

(21) Appl. No.: 13/323,908

(22) Filed: Dec. 13, 2011

(65) Prior Publication Data

US 2013/0147628 A1 Jun. 13, 2013

(51) Int. Cl.
*G08B 21/00* (2006.01)

(52) U.S. Cl.
USPC ..... 340/687; 340/686.1; 340/692; 340/573.1

(58) Field of Classification Search
USPC ..... 340/687, 573.1, 686.1, 691.1, 692, 6.1, 340/384.4
See application file for complete search history.

(56) References Cited

U.S. PATENT DOCUMENTS 4,908,607 A * 3/1990 Yannotti et al. ..... 340/571
5,512,881 A * 4/1996 Majmudar ..... 340/574
5,635,908 A * 6/1997 Soper ..... 340/574
5,903,219 A * 5/1999 Chen ..... 340/574
6,049,277 A * 4/2000 Osame ..... 340/568.7
6,285,867 B1 9/2001 Boling et al.
7,002,466 B2 * 2/2006 Goehring ..... 340/539.11
7,800,482 B1 * 9/2010 Costin et al. ..... 340/321

FOREIGN PATENT DOCUMENTS

CN 1652559 A 8/2005
GB 2 412 217 A 9/2005

* cited by examiner

*Primary Examiner* — Toan N Pham
(74) *Attorney, Agent, or Firm* — Renner, Otto, Boisselle & Sklar, LLP

(57) ABSTRACT

The present invention relates to a personal audio cable device comprising a personal alarm being easily accessible to a user. The personal audio device is configured to relay electric audio signals to a personal hearing device, said personal audio cable device comprising an electric signal receiving unit, a jack socket configured to receive a jack plug of the personal hearing device. The personal audio cable device comprises an audio alarm unit, and an audio alarm actuating circuit, wherein the audio alarm unit is configured to generate an audio frequency alarm when actuated and triggered by disengaging the jack plug of the hearing device from the jack socket of the personal audio cable device. The audio alarm unit may in also dial up an emergency rescue number, upon actuation. The invention provides how to easily actuate an audio alarm when being attacked by an intruder.

11 Claims, 2 Drawing Sheets

PERSONAL AUDIO CABLE ALARM DEVICE

TECHNICAL FIELD

The present invention relates to an arrangement in an audio cable, in particular it relates to an arrangement for generating an audio alarm.

BACKGROUND

Personal alarm or attack alarms have become more popular nowadays. Upon disengaging a lever or a ring from the personal or attacks alarms or the like, an irritating and disturbing noise is generated. The intention of generating this noise is to disturb and/or surprise an intruder and thereby preventing continued assault.

Prior art personal alarms have the disadvantage that they are difficult to actuate upon an attack since they are often designed to be carried in a pocket och inside a bag, which prevents quick access when being attacked. In addition, personal alarms have a relatively small size, which means that alarms carried in a bag or in a pocket may first have to be searched, after which it can be accessed and actuated to produce an irritating noise or disturbing sound that is intended to stop the assault.

In addition, a personal alarm designed to be carried in a bag or worn in a pocket can easily be forgotten elsewhere or left behind, leaving for instance a girl or boy jogging without her or his personal alarm, at instances when the personal alarm may be needed the most.

There is thus a need to provide a personal alarm that is easily accessible when used and that can be easily actuated, increasing the usefulness of personal alarms.

SUMMARY

It is an object of the present invention to provide a personal audio alarm that can be actuated easily by a user.

This is achieved by combining a personal audio device and an audio alarm.

According to an aspect of the present invention, there is provided a personal audio cable device configured to relay at least electric audio signals to a personal hearing device, said personal audio cable device comprising an electric signal receiving unit, configured to receive at least electric audio signals from a portable electronic device, a jack socket electrically connected to the electric signal receiving unit and configured to receive a jack plug of the personal hearing device thereby establishing electric contact between the jack socket and the jack plug so that the jack socket can forward the at least electric audio signals to said personal hearing device via the jack plug of the personal hearing device, an audio alarm unit, configured to generate an audio frequency alarm upon actuation, and an alarm actuating circuit electrically connected to the audio alarm unit and to the jack socket, and configured to actuate an activated audio alarm unit, upon disengaging the jack plug of the hearing device from the jack socket of the personal audio cable device.

The audio alarm actuating circuit within the personal audio cable device may further comprise a de-activating user input unit configured to de-activate the normally activated audio alarm unit, based on the position of said de-activating user input unit, for preventing of actuation of the audio alarm unit upon disengaging the jack plug of the personal hearing device from the jack socket of the personal audio cable device.

The audio alarm unit of the personal audio cable device may further comprise a telephone unit configured to control transmission of an at least alarm related signal by dialing up an alarm number upon actuation.

The audio alarm unit of the personal audio cable device may comprise a communication unit, a Subscriber Identity Module, SIM card and a transmitter, wherein the transmitter is configured to transmit a connection request to an emergency help-line party, for at least assisting in positioning of the personal audio device, and informing rescue personal about the actuated alarm.

The communication unit of the personal audio cable device may be a telephone unit.

The audio alarm unit of the personal audio cable device may comprise an electric alarm signal generator, an alarm signal amplifier and a speaker, wherein the electric alarm signal generator is configured to generate an alarm signal, wherein the alarm signal amplifier is electrically connected to the alarm signal generator and configured to amplify said generated electric alarm signal and wherein the speaker is configured to transduce the generated electric alarm signal as an audio frequency alarm signal upon actuation of the audio alarm unit.

The electric signal receiving unit of the personal audio cable device may comprise a jack plug configured to be inserted into a jack socket of a portable electronic device, establishing electrical contact between the jack plug and the jack socket, so that electric audio signals can be received by the jack plug of the electric signal receiving unit from the jack socket of the portable electronic device, and forwarded to the jack socket of the personal audio cable device for relaying the electric audio signals to the jack plug of the hearing device.

The electric signal receiving unit of the personal audio cable device may further comprise a communication unit for wirelessly receiving electric audio signals from the portable electronic device so that the electric audio signals can be forwarded to the jack socket of the personal audio cable device for relaying the electric audio signals to the jack plug of the hearing device.

The electric signal receiving unit of the personal audio cable device may further comprise a Bluetooth® unit.

The at least one of a jack plug and the jack socket, of the personal audio cable device, may be of the Tip and Sleeve, TS, type having null, one, two, or three rings, thus forming a Tip Sleeve, TS; Tip Ring Sleeve, TRS; Tip Ring Ring Sleeve, TRRS; or Tip Ring Ring Ring Sleeve, TRRRS type connector, respectively.

The personal audio cable device may further comprise means configured for reversibly fastening the personal audio cable device to a garment of the wearer.

By providing a personal alarm comprised in a personal audio cable device, the alarm is automatically worn or used when listening on music, using the telephone or the like. For this reason it is not left behind because the user quickly notices when his or her favorite music is no longer around.

In addition, it is an advantage that the personal audio equipment comprises a jack socket such that a personal hearing device can be connected, so that an audio cable, being easily accessible by one or two hands when worn, is provided as means for actuating the audio alarm for disengaging the personal hearing device from the personal audio device.

It is further an advantage that the wearer can actuate the alarm of a fastened personal audio cable device, single-handed.

BRIEF DESCRIPTION OF DRAWINGS

In order to explain advantages and features of the present invention herein in more detail a few embodiments will be described below, where references are made to the accompanying drawings, for which

DETAILED DESCRIPTION

The personal audio cable device as herein described refers to an audio cable alarm device that is configured to generate a penetrating audio alarm signal upon actuation. In order to provide a personal alarm that is easily accessible when worn, an audio cable alarm device has thus been invented.

Listening to music in ear phones or ear plugs is becoming increasingly popular. Listening to sound books and radio programs for that matter is also popular among a vast number of people. Nowadays, this is often done by using a mobile phone having applications installed or access to various services.

The mobile phone and ear phones or ear plugs are good examples of communication equipment which can be connected to the personal audio device, according to the present invention.

Figure 1:
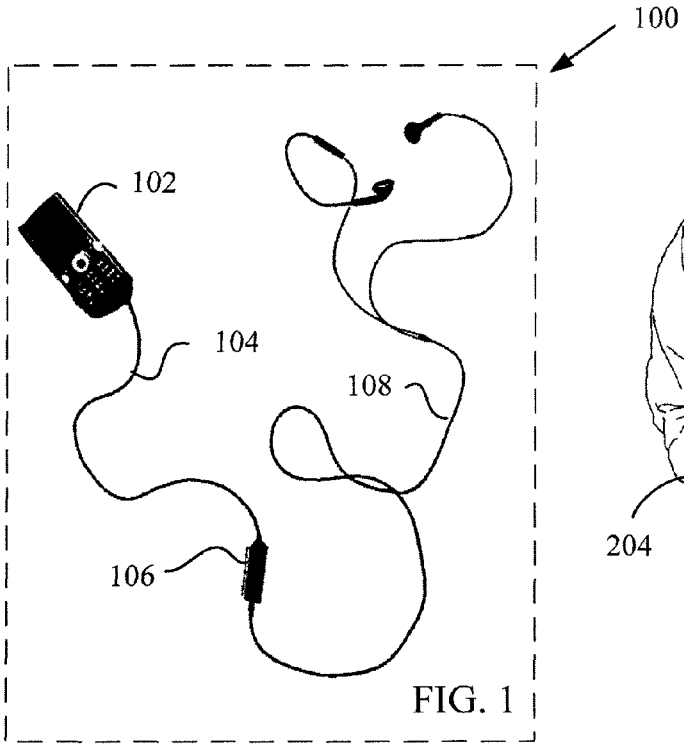
FIG. 1 illustrates a personal audio cable device according to embodiments of the present invention, operatively connected to typical external communication equipment.

FIG. 1 illustrates a personal audio device 104, 106 according to embodiments of the present invention, operatively connected to a mobile phone 102 and to ear phones 108, being examples of external communication equipments. The personal audio device can comprise a body part 106 and a cable part 104, of which a first end of the cable part is connected to the body part, whereas a second end of the cable part has attached a signal receiving unit. This signal receiving unit may be in the form of a jack plug. The jack plug is thus adapted to be connected to a mobile phone or an mp3-player or the like that can deliver electric audio signals for listening using ear phones. The body part 106 of the personal audio device comprises a jack socket configured to receive a jack plug of an external audio equipment such as the ear phones 108. Hence, FIG. 1 thus illustrates such a configuration of a personal audio device, connected to a mobile phone 102 and ear phones 108.

Figure 2:
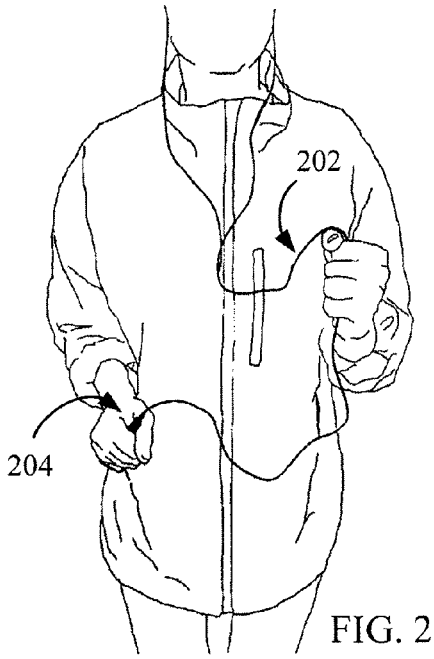
FIGS. 2 and 4 illustrate the wearing of the personal audio cable device according to embodiments of the present invention.

As the personal audio device is configured to be easily accessible and to be easily actuated, a few figures will be presented below in order to show how to wear the personal audio device according to the present invention. FIG. 2 schematically illustrates preferred wearing of the personal audio device according to some embodiments of the present invention. FIG. 2 depicts a person wearing ear phones having a cable 202 connected to the body portion of the personal audio device 204. By connecting the cable to the ear phones to the body portion of the personal audio device, the person has immediate access to the ear phones cable 202. In addition, the person also has immediate access to the body portion of the personal audio device 204, when attaching the body portion of the personal audio device to the person's clothes by using for instance a clip. Wearing the personal audio device easily accessible permits the person to easily grip the ear phone cable 202 by one hand and the body portion of the personal audio device by the other hand, as indicated in FIG. 2.

Figure 3:
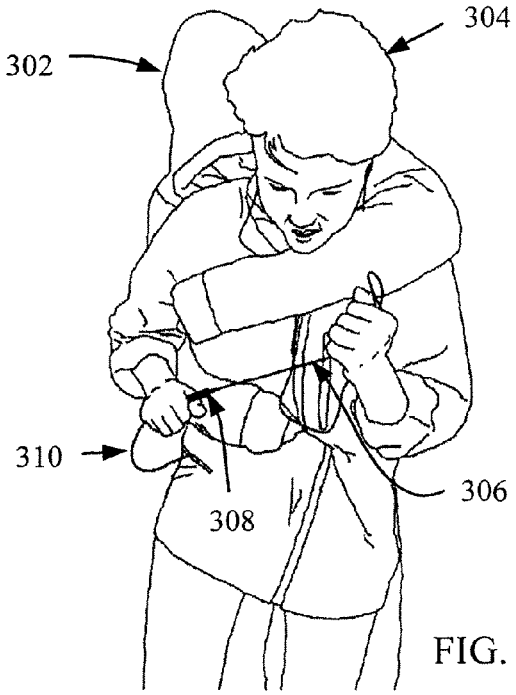
FIG. 3 illustrates a possible assault scenario related to the personal audio device according to at least some embodiments of the present invention.

FIG. 3 illustrates a possible scenario of an intruder assaulting a person wearing a personal audio device according to the present invention. The intruder 302 for instance approaching the person's back here holds the persons body, in an attempt prevent the person, wearing the personal audio device, from escaping. The person likely to face a shock desperately tries to free her or his hands, now grips the ear phone cable 306 with a first hand and the body portion 308 or the cable portion 310 of the personal audio device with the second hand and pulls them apart. Upon pulling the ear phone cable 306 and the body portion 308 apart, an audio alarm of the personal audio device is actuated.

Figure 4:
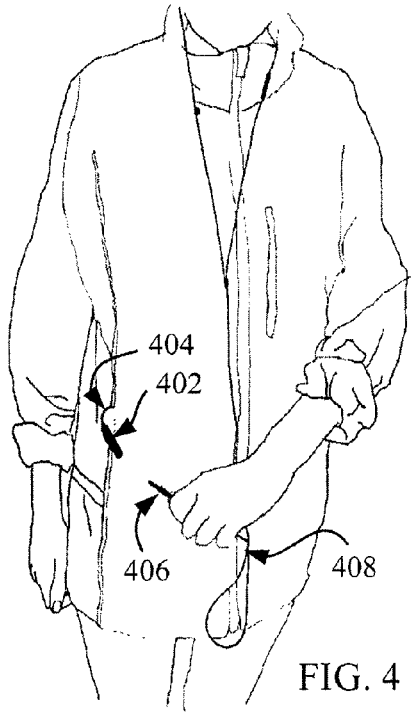

FIG. 4 schematically illustrates the wearing of the personal audio device according to some embodiments of the present invention, when the personal audio device is attached to a pocket or the like by a clip. FIG. 4 discloses a body portion 402 of an audio alarm device, a cable 404 between the body portion 402 and an audio receiving unit, an ear phone cable 408, a jack plug 406 at the end of the ear phone cable 408.

It should be noted that the body portion of the audio alarm device can be advantageously reversibly mounted or firmly attached to a garment or the like by using means for fastening, such as a clip.

Pulling the ear phone cable 408 of an ear phone cable connected to a mounted or firmly attached audio alarm device, will cause the ear phone cable to disengage from the body portion 402, for the reason that the body portion is mounted or firmly attached to the garment, such as a pocket, or the like. Since pulling a cable can easily be done using a single hand, the wearer will have a higher possibility to actuate the alarm when being attacked by an intruder, as compared with one hand holding the ear phone cable and the other holding the body portion, pulling them apart.

According to one embodiment of the present invention the personal audio device is configured to provide a powerful and irritating audio signal when being actuated, in the form of a siren, an irritating sound or disturbing noise. The audio signal may be comprise substantially one or more audio frequencies. Any kind of audio signal taking the intruder unawares may be used. For instance, especially irritating audio frequencies up to approximately 12 kHz can be used. However, audio frequencies that are penetrating and can easily propagate outdoors may be preferred.

According to one embodiment of the present invention the personal audio device may in addition be configured to dial-up an emergency telephone number upon actuation, for at least assist in positioning of the personal audio device and informing rescue personal about the actuated alarm.

Now, according to a first mode of operation disengaging the jack plug of the ear phones from the jack socket of the personal audio device, actuates said personal audio alarm and provides said powerful audio alarm. The intruder is taken unawares by the irritating noise and runs away leaving the person unharmed but in a shocked condition.

Figure 5:
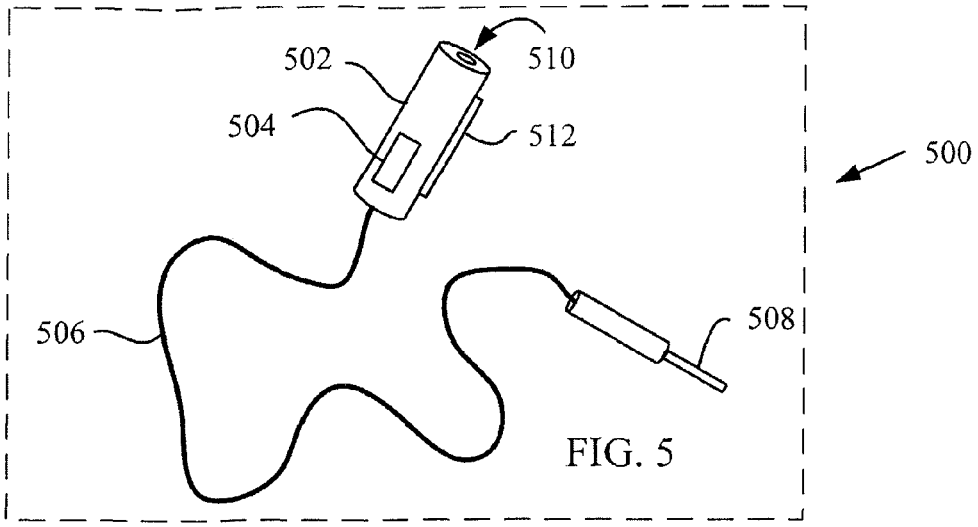
FIG. 5 illustrates a personal audio cable device according to some embodiments of the present invention.

Before describing the personal audio device in some detail, FIG. 5 is presented, illustrating the personal audio device comprising a body portion 502 having a de-activating input unit 504 in the form of a switch, a cable 506 and an electric signal receiving unit 508 in the form of a jack plug. The body portion of the personal audio device further comprises a jack socket 510 configured to receive a jack plug of ear phones or ear plugs.

The jack plug 508 is thus configured to be connected to a mobile phone or a mp3-player or the like, producing an electric audio signal, which said jack plug 508 can forward to the body portion of the personal audio device.

It should be emphasized that the body portion of the personal audio device is configured to relay the electric audio signals to the ear phones via the jack socket 510 of the body portion 502 of the personal audio device 500 and the jack plug of the ear phones, when the jack socket 510 is receiving the jack plug of the ear phones.

In addition, FIG. 5 schematically illustrates fastening means 512 for reversibly mounting or firmly attaching the personal audio device to a garment of the user.

Figure 6:
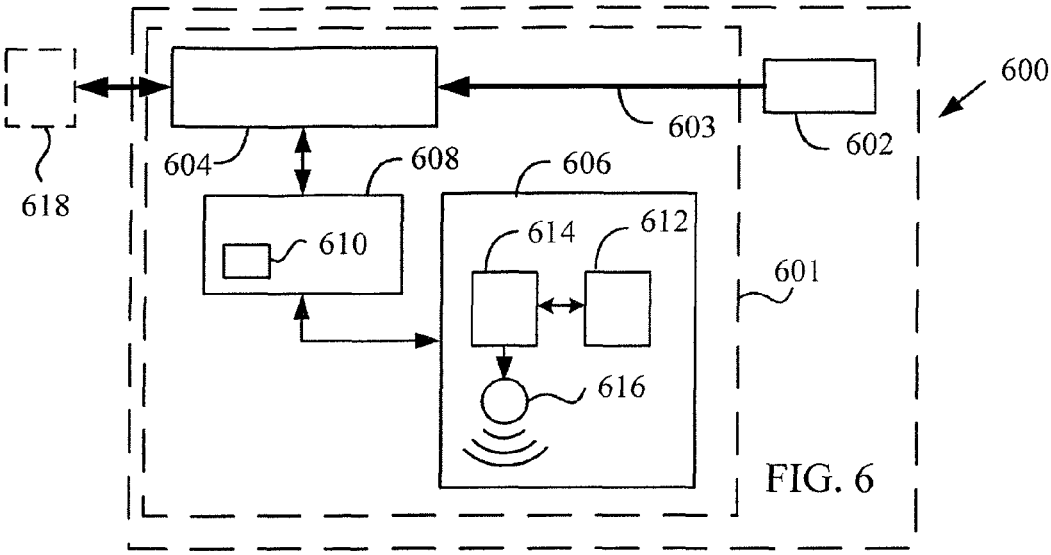
FIG. 6 illustrates a schematic presentation of a personal audio cable device according to some embodiments.

Now, FIG. 6 illustrates the personal audio device 600 in some detail. The personal audio device comprises a body portion 601, to which an electric signal receiving unit 602 is connected via an electric audio signal cable 603. The electric signal receiving unit 602 may be realized as the jack plug 508.

According to some embodiments of the present invention, the body portion comprises a jack socket 604, an audio alarm unit 606 and an actuating circuit 608.

The personal audio device is thus configured to relay at least electric audio signals to a personal hearing device, such as ear phones.

The electric signal receiving unit 602, of the personal audio device is configured to receive at least electric audio signals from a portable electronic device, such as a mobile phone or an mp3-player, to mention two examples only. The jack socket 604 of the personal audio device is electrically connected to the electric signal receiving unit 602 and configured to receive a jack plug 618 of the personal hearing device thereby establishing electric contact between the jack socket and the jack plug so that the jack socket can forward the at least electric audio signals to said personal hearing device via the jack plug of the personal hearing device.

According to some embodiments of the present invention, the audio alarm unit 606 of the personal audio device is configured to generate an audio frequency alarm upon actuation. The alarm actuating circuit 608 can be operatively electrically connected to the audio alarm unit 606 and to the jack socket 604, and can be configured to actuate the audio alarm unit 606, upon disengaging the jack plug 618 of the hearing device from the jack socket 604 of the personal audio cable device. According to one mode of operation the audio alarm unit is actuated by disengaging the jack plug 618 from the jack socket 604 of the personal audio device 600.

The alarm actuating circuit 608 of the personal audio cable device 500, 600 may also comprise a de-activating user input unit 610 configured to de-activate the normally activated audio alarm unit 606, based on the position of said de-activating user input unit, for preventing of actuation of the audio alarm unit upon disengaging the jack plug 618 of the ear phones from the jack socket 510, 604 of the personal audio device 500, 600. This is according to a second mode of operation of the personal audio device, enabling replacing the ear phones by another pair of phones, without actuating the audio alarm unit to provide the audio alarm.

The audio alarm unit 606 of the personal audio device 500, 600 can thus comprise an electric alarm signal generator 612, an alarm signal amplifier 614 and a speaker 616, wherein the electric alarm signal generator 612 is configured to generate an alarm signal, wherein the alarm signal amplifier 614 is electrically connected to the alarm signal generator and configured to amplify said generated electric alarm signal and wherein the speaker 616 is configured to transduce the generated electric alarm signal as an audio frequency alarm signal upon actuation of the audio alarm unit.

The alarm unit 606 of the personal audio device 500, 600 may in addition comprise a telephone unit, a Subscriber identity Module, SIM card and a transmitter, wherein the telephone unit is configured to dial up an emergency phone number. This may start by transmitting a connection setup request to an emergency help-line. Receipt of an emergency call may then trigger positioning of the personal audio device, and forward the alarm to rescue personal at guard to rescue people in trouble.

Figure 7:
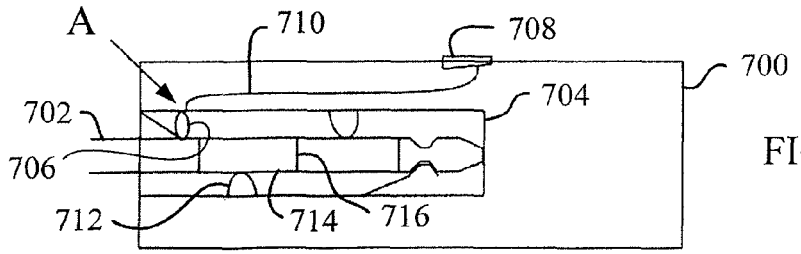
FIGS. 7 and 8 illustrate a portion of a personal audio cable device in some detail, according to some embodiments of the present invention.
Figure 8:
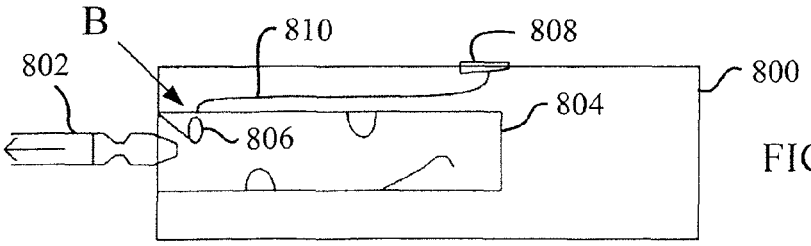

Some embodiments of the jack socket of the personal audio device will now be described with reference to FIGS. 7 and 8, illustrating the body portion 700, 800 of the personal audio device in some detail. It should be noted that FIGS. 7 and 8 intend to present one way of realizing the jack socket. The present invention is however not limited to this embodiment of the jack socket, but encompasses a large variety of electrical, mechanical and/or electro-mechanical realizations of the jack socket comprising alarm actuating means.

FIG. 7 illustrates a jack plug 702 of a personal hearing device such as ear phones, which jack plug is received in a jack socket 704 of the personal audio. In addition the jack socket comprises an alarm actuating means 706 mounted on a resilient member, such that the alarm actuating means contacts a first end of an actuating cable 710 when the jack plug is received in the jack socket, as indicated by "A". The second end of the actuating cable is electrically connected to the de-activating user input unit, which may be realized as a mechanical or an electrical switch 708, 808.

When the jack plug of the ear phones is received the actuating means may not be operatively used.

However, when disengaging the jack plug from the jack socket, as illustrated in FIG. 8, the actuating means is affected by the jack plug leaving the jack socket. In FIG. 8 it is illustrated the jack plug 802 leaving the jack socket 804 upon which the alarm actuating means 806, resiliently mounted, is bent inwards disconnecting the electrical contact between said alarm actuating means 806 and the first end of the actuating cable 810, as indicated with "B". According to a first mode of operation the alarm actuating means now actuates the audio alarm unit 606.

The mode of operation may be set by the de-activating user input unit, realized by the switch 708, 808. Upon disengaging the jack plug 802 from the jack socket 804 the alarm actuating means may actuate the audio alarm unit, based on the position of the switch 808.

A first position of the switch causes the personal audio device to enter a first mode of operation upon disengaging the jack plug from the jack socket. A second position of the switch however causes the personal audio alarm to enter a second mode of operation upon disengaging the jack plug from the jack socket. In the first mode the audio alarm is actuated, whereas in the second mode of operation the audio alarm is not actuated upon disengaging the jack plug from the jack socket.

It can be mentioned that the jack socket of the personal audio device 500, 600 may be of the Tip and Sleeve, TS, type having null, one, two, or three rings, thus forming a Tip Sleeve, TS; Tip Ring Sleeve, TRS; Tip Ring Ring Sleeve, TRRS; or Tip Ring Ring Ring Sleeve, TRRRS type connector, respectively. This indicated in FIG. 7, wherein 714 denotes a sleeve and 716 an insulating ring.

It must also be emphasized that the present invention can be varied in many ways. The presented embodiments of the present invention are only a few examples of the variety of embodiments that are comprised within the present invention.

Among the advantages of at least some of the embodiments of the present invention the following can be mentioned:

By providing a personal alarm comprised in a personal audio equipment such as the personal audio cable device according to embodiments of the present invention, the alarm will automatically be available and easily accessible to people participating in a telephone conversation or listening to music or radio, or the like.

In addition, it is an advantage that the personal audio cable device comprises a jack socket such that a personal hearing device can be connected, so that an easily accessible audio cable is provided as part of actuating means for actuating the audio alarm when disengaging the jack plug of the ear phones from the jack socket of the personal audio device.

The invention claimed is:

1. A personal audio cable device configured to relay at least electric audio signals to a personal hearing device, said personal audio cable device comprising:

an electric signal receiving unit, configured to receive at least electric audio signals from a portable electronic device, a jack socket electrically connected to the electric signal receiving unit and configured to receive a jack plug of the personal hearing device thereby establishing electric contact between the jack socket and the jack plug so that the jack socket can forward the at least electric audio signals to said personal hearing device via the jack plug of the personal hearing device, an audio alarm unit, configured to generate an audio frequency alarm upon actuation, and an alarm actuating circuit electrically connected to the audio alarm unit and to the jack socket, and configured to actuate an audio alarm unit, upon disengaging the jack plug of the hearing device from the jack socket of the personal audio cable device.

2. The personal audio cable device according to claim 1, wherein the alarm actuating circuit further comprises a de-activating user input unit configured to de-activate the normally activated audio alarm unit, based on the position of said de-activating user input unit, for preventing of actuation of the audio alarm unit upon disengaging the jack plug of the personal hearing device from the jack socket of the personal audio cable device.

3. The personal audio cable device according to claim 1, wherein the audio alarm unit comprises a telephone unit configured to control transmission of an at least alarm related signal by dialling an alarm number upon actuation.

4. The personal audio cable device according to claim 3, wherein the audio alarm unit comprises a communication unit, a Subscriber Identity Module (SIM) card and a transmitter, wherein the transmitter is configured to transmit a connection request to an emergency help-line party, for at least assisting in positioning of the personal audio device, and informing rescue personal about the actuated alarm.

5. The personal audio cable device according to claim 4, wherein the communication unit is a telephone unit.

6. The personal audio cable device according to claim 1, wherein the audio alarm unit comprises an electric alarm signal generator, an alarm signal amplifier and a speaker, wherein the electric alarm signal generator is configured to generate an alarm signal, wherein the alarm signal amplifier is electrically connected to the alarm signal generator and configured to amplify said generated electric alarm signal and wherein the speaker is configured to transduce the generated electric alarm signal as an audio frequency alarm signal upon actuation of the audio alarm unit.

7. The personal audio cable device according to claim 1, wherein the electric signal receiving unit comprises a jack plug configured to be inserted into a jack socket of a portable electronic device, establishing electrical contact between the jack plug and the jack socket, so that electric audio signals can be received by the jack plug of the electric signal receiving unit from the jack socket of the portable electronic device, and forwarded to the jack socket of the personal audio cable device for relaying the electric audio signals to the jack plug of the hearing device.

8. The personal audio cable device according to claim 1, wherein the electric signal receiving unit comprises a communication unit for wirelessly receiving electric audio signals from the portable electronic device so that the electric audio signals can be forwarded to the jack socket of the personal audio cable device for relaying the electric audio signals to the jack plug of the hearing device.

9. The personal audio cable device according to claim 8, wherein the electric signal receiving unit comprises a Bluetooth ® unit.

10. The personal audio cable device according to claim 1, where at least one of a jack plug and the jack socket is of the Tip and Sleeve, TS, type having null, one, two, or three rings, thus forming a Tip Sleeve, TS; Tip Ring Sleeve, TRS; Tip Ring Ring Sleeve, TRRS; or Tip Ring Ring Ring Sleeve, TRRRS type connector, respectively.

11. The personal audio cable device according to claim 1, further comprising means configured for reversibly fastening the personal audio cable device to a garment of the wearer.

* * * * *